United States Patent [19]

Siler, Jr. et al.

[11] 4,040,236

[45] Aug. 9, 1977

[54] MEANS FOR COMPENSATING CONTAINER FEED TRIP FOR SPEED CHANGES

[75] Inventors: Harold L. Siler, Jr., Rockbridge; Cecil P. Roberts, Carroll, both of Ohio

[73] Assignee: Anchor Hocking Corporation, Lancaster, Ohio

[21] Appl. No.: 651,060

[22] Filed: Jan. 21, 1976

[51] Int. Cl.[2] ..... B65B 57/02; B65B 57/08

[52] U.S. Cl. ..... 53/67; 53/317

[58] Field of Search ..... 53/38, 64, 67, 68, 69, 53/70, 77, 308, 317

[56] References Cited

U.S. PATENT DOCUMENTS

| | | | |
|---|---|---|---|
| 2,906,072 | 9/1959 | Carlson | 53/67 |
| 3,018,593 | 1/1962 | Nelson | 53/67 |
| 3,714,760 | 2/1973 | Roberts et al. | 53/308 X |

*Primary Examiner*—Othell M. Simpson
*Assistant Examiner*—Horace M. Culver
*Attorney, Agent, or Firm*—Holland, Armstrong, Wilkie & Previto

[57] ABSTRACT

A method and means are described for improving the feeding of closures and containers to a sealing machine. Sealing machines utilize container controlled trips for controlling the stop and start of the closure feed to the sealing section to synchronize the container and closure feeds. Means is provided for compensating the action of the container controlled trip in accordance with the operating speed of the sealing machine. This permits changes in the machine speed to occur or to be made while retaining the necessary synchronization of the cap and the container feeds.

10 Claims, 6 Drawing Figures

1
2
2
4
4
5
6
7
8
9
10
11
14
20
21
22
24
25

4
11
12
13
14
15
16
21
23
24
25
26
27
28
29
7
3

AIR VALVE
PROXIMITY DETECTOR CONTROL
PROXIMITY DETECTOR

MEANS FOR COMPENSATING CONTAINER FEED TRIP FOR SPEED CHANGES

BACKGROUND OF THE INVENTION

This invention relates to the container sealing art and more particularly to a method and means for compensating the control of the closure feed stop and start in accordance with the sealing machine operating speed.

Automatic sealing machines operate at extremely high speeds to seal containers at rates as high as one to two thousand containers per minute. In order for the sealing machines to operate at these high speeds, the supply of the filled containers must be coordinated with a correspondingly high speed feeding of the closure caps. Synchronization of the cap feed and the container feed requires the closure feed to be stopped and started in accordance with the feed of the containers. In view of the extremely high feeding rates in use and of the differing masses of the feed systems employed for the containers and caps, changes in machine speed have resulted in a loss of synchronism between the cap and container feed.

Occasionally, for example, after a change in machine speed and upon a break in the supply of containers, the stop controlling the cap feed operates too slowly in cutting off the cap feed. This leaves one or more extra caps in the sealing machinery resulting in a loss of container and cap feeding synchronization. A similar failure of synchronization on the start-up may cause caps to be fed in advance of the containers. A failure of synchronization resulting from a machine speed change may also cut the cap feed off prematurely resulting in unsealed containers.

The method and means of the present invention provide an automatic correction of the cap feed control. The method and means operate to advance or retard the control action responsive to machine speed changes so that an exact number of caps are fed at all times.

Accordingly, an object of the present invention is to provide an improved control system for sealing machine cap feeds.

Another object of the present invention is to provide an improved cap feed for sealing machines which is speed compensated.

Another object of the present invention is to provide an improved sealing machine jar trip which is compensated for changes of the sealing machine speed.

Another object of the invention is to provide a rugged and relatively simple and automatic speed compensating means for seaiing machine container trip systems.

Other and further objects of the invention will be obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

Figure 1:
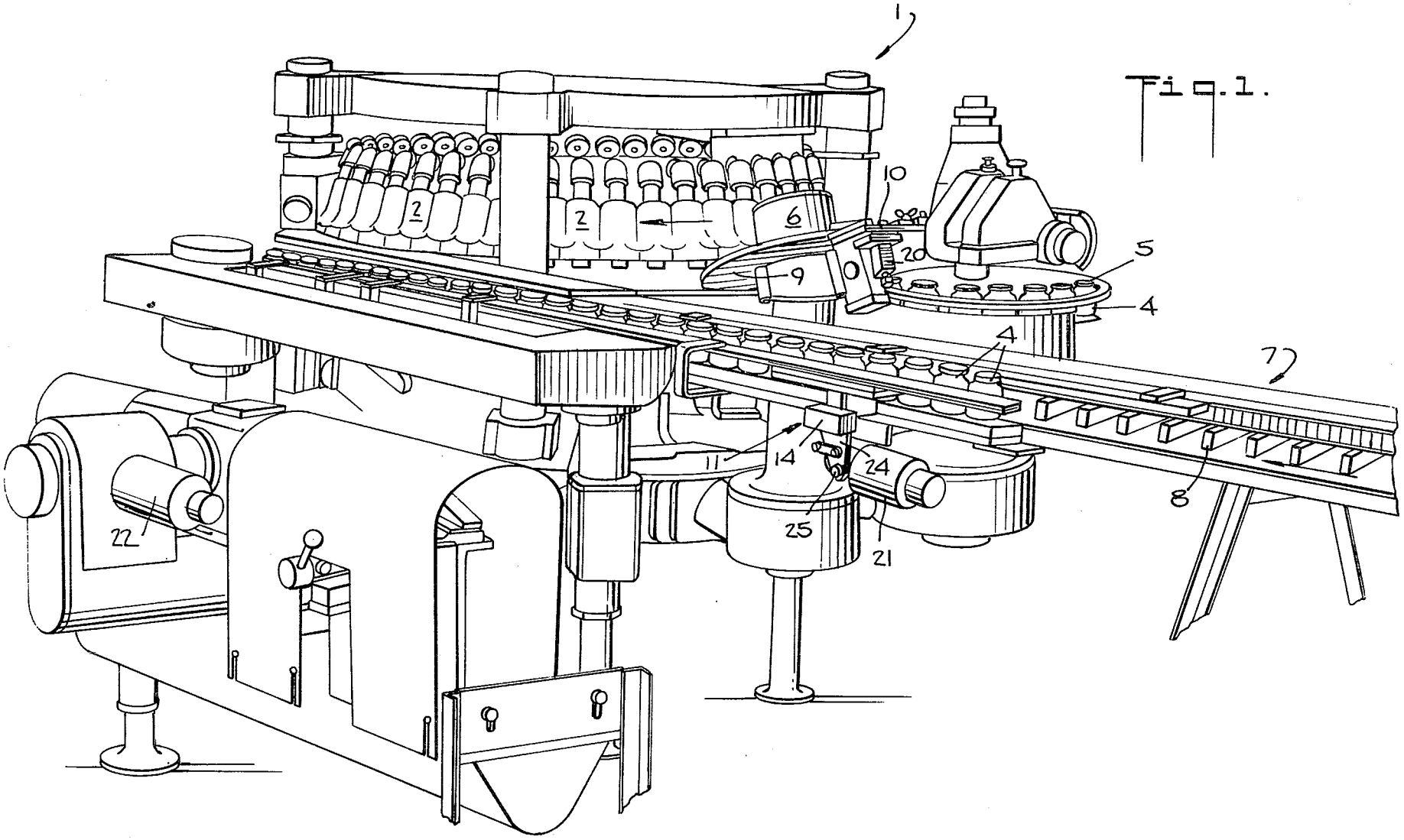
FIG. 1 is a perspective view illustrating the present invention as used with a high speed rotary container sealing machine.

A description of a preferred embodiment of the speed compensated feed system in accordance with the present invention will be given with reference to a rotary sealing machine as illustrated in FIG. 1. This machine is of the type, for example, as described in U.S. Pat. No. 3,714,760. The method and means of the invention may be used on other sealing machines having container and cap feeds.

In such a sealing machine 1, a number of sealing heads 2 are positioned around the periphery of a rotating turret 3. Filled containers 4 are fed under the sealing heads 2 at one point on the turret 3 periphery as closure caps (FIGS. 5 and 6) are fed to the sealing heads 2 at another position by a cap feed 6. One closure cap 5 must be fed to each sealing head 2 to seal a container 4 fed under the same sealing head 2. This synchronized feed of closure caps 5 and the containers 4 must be maintained as the supply of containers 4 is started and stopped and as the speed of the sealing machine 1 is varied for safety or for inspection or for other reasons.

FIG. 1 illustrates a conveyor 7 feeding a line of containers 4 to the sealing machine 1. Filled containers 4 are moved along the conveyor 7 and under the turret 3 of the sealing machine 1 where a sealing head applies the closure cap 5 to each filled container 4. A portion of the infeed conveyor 7, illustrated in FIG. 1, includes a jar spacing mechanism in the form of an endless chain driving container 4 spacing bars 8. The bars 8 space the containers 4 for delivery onto suitable supports on the turrent 3 of the sealing machine 1 so that one container 4 is present beneath each container sealing head 2.

Each sealing head 2 of the sealing machine 1 includes means for receiving and supporting a closure cap 5 from the cap feed means 6. The cap feed means 6, for example, may comprise a rotating star wheel or disc 9 (FIG. 5) which is rotated in synchronism with the sealing machine turret 3 so that one closure cap 5 is presented to each of the sealing heads 2 as the heads 2 move past the cap feed 6.

Occasionally the supply of containers 4 is terminated at the end of a run or during an interruption in the container filling or feeding operation. When this occurs, there will be no containers 4 fed beneath certain of the sealing heads 2 on the sealing machine 1. It is then necessary that the cap feed 6 also be cut off to prevent the feeding of unneeded closure caps 5 into the sealing machine 1 to avoid the presence of excess caps 5 within the sealing machine structure.

In order to control the cap feed 6 in accordance with the stopping and starting of the container feed or the conveyor 7, a container sensing device is positioned at the container infeed conveyor 7. As illustrated in FIGS.

2 and 4, this detecting device 11 comprises a pivotally mounted sensing arm 12 which is held outwardly of the conveyor 7 when containers 4 are present thereon and which swings inwardly of the conveyor 7 under the force of a coil spring 13 in the absence of containers. A switch such as a proximity detector 14 is mounted adjacent to the sensing arm 12 so that a metal actuating bar 15 on the sensing arm support 16 then approaches and activates the proximity detector 14.

Figures 5, 6:
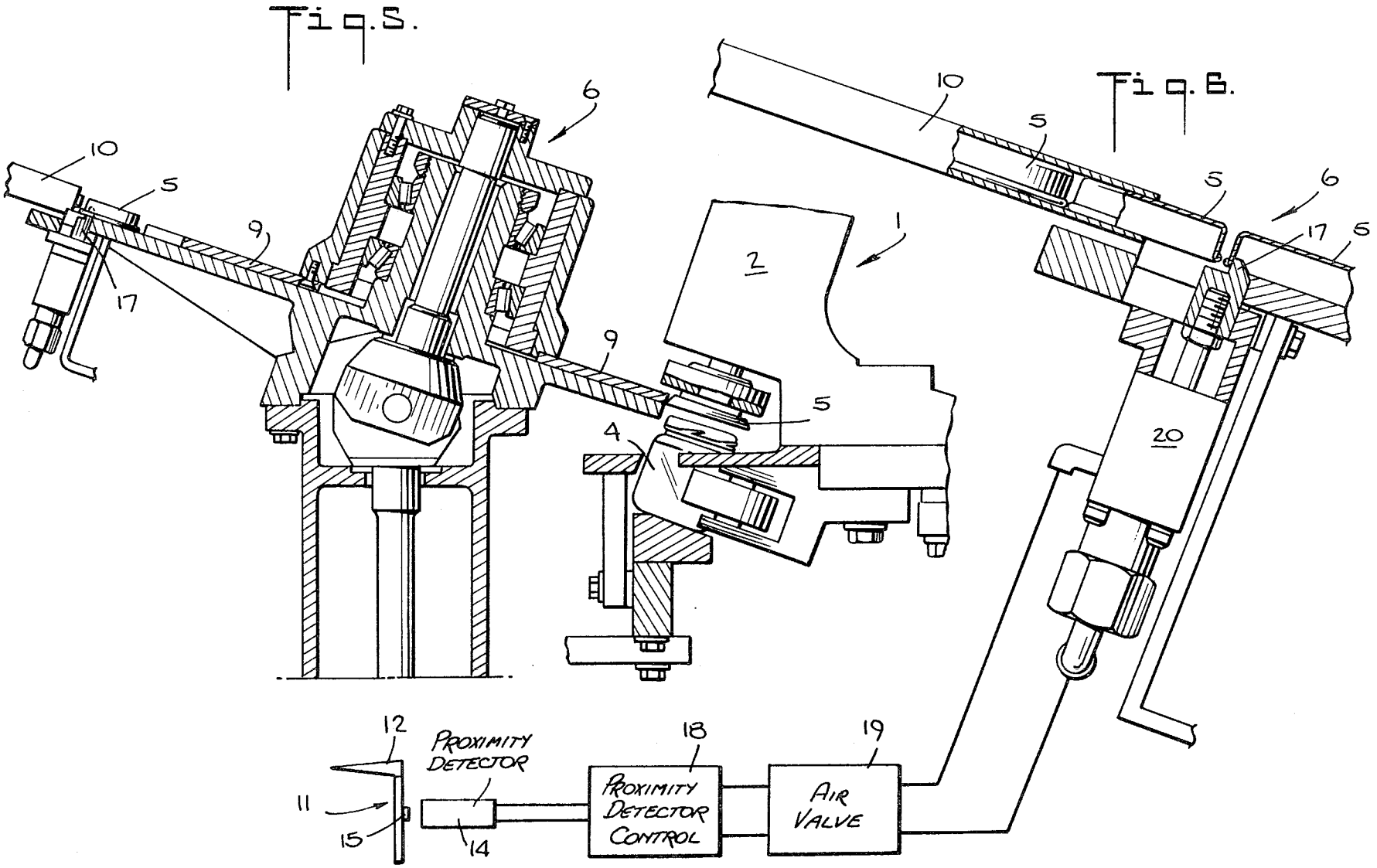
FIG. 5 is a vertical sectional view of a cap feed as controlled by the method and means of the present invention.
FIG. 6 is an enlarged side elevational view, partially in section, of a cap stop in accordance with the present invention.

The proximity detector 14 controls the operation of a movable cap stop 17 mounted in the cap feed system 6 as illustrated in FIGS. 5 and 6. When the sensing device 11 at the container feed conveyor 7 detects the absence of a container 4, it activates the proximity detector 14 which is coupled through a suitable electrical control 18 to an air valve 19 for an air cylinder or air motor 20 which raises the cap stop 17. This causes the stop 17 to engage a closure cap 5 within the cap feed chute 10 as illustrated in FIGS. 5 and 6 to terminate the further feeding of closure caps 5 into the cap feeding star wheel 9. The positioning of the container detecting device 11 on the container conveyor 7 is set in cooperation with the positioning of the cap stop 17 so that the number of containers 4 between the container detecting device 11 and the turret 3 is equal to the number of caps 5 between the sealing machine and the cap stop 17. Thus, one closure cap 5 is present beyond the cap feed stop 17 for each of the remaining containers 4 being fed to the sealing machine 1.

This general system of synchronizing the container feed with the closure cap feed is known. As the sealing machine 1 speed is changed, however, the necessary exact synchronization is lost between the action of the container detecting device 11 and the cap stop 17. At higher speeds, the delay inherent in the detection of missing containers delays the operation of the cap stop 17 causing one or more unneeded caps 5 to be fed into the sealing machine 1 where they are not needed and where their presence may cause unnecessary jamming of the sealing equipment. Should the detecting device 11 be adjusted to overcome this by a simple repositioning, the result may be a premature cut-off of the cap feed 6 at the cap stop 17 resulting in an absence of closure caps 5 in the sealing machine 1 for the last one or two containers so that they remain unsealed. Corresponding failures of synchronism also are present in the start-up action when the container supply is re-established resulting in similar undesirable over or under feeding of closure caps 5.

The improved control method and means described below overcomes this problem by adjusting the action of the detecting device 11 and the cap stop 17 in accordance with the operating speed of the sealing machine 1. This is done by providing a coupling between the sealing machine 1 speed control and a means for adjusting the physical position of the container detecting device 11 on the container feeding conveyor 7. A preferred embodiment of this device is illustrated in detail in FIGS. 2 through 4.

One effective and widely used method of controlling the operating speeds of sealing machines is the use of an air pressure operated speed control. These sealing machines include a mechanical speed adjustment for the drive motor which is operated by an Annin actuator. An Annin actuator is an air controlled device in which the physical position of the actuator piston rod is proportional to the pressure of the control air supplied to the actuator. The actuator control rod, for example, is coupled to the sealing machine speed control. Preferably the air pressure is employed in a fail-safe mode so that higher machine speeds result from higher air pressures applied to the actuator. In the event of an air failure, this type of control automatically slows down the sealing machine.

Figures 2, 3, 4:
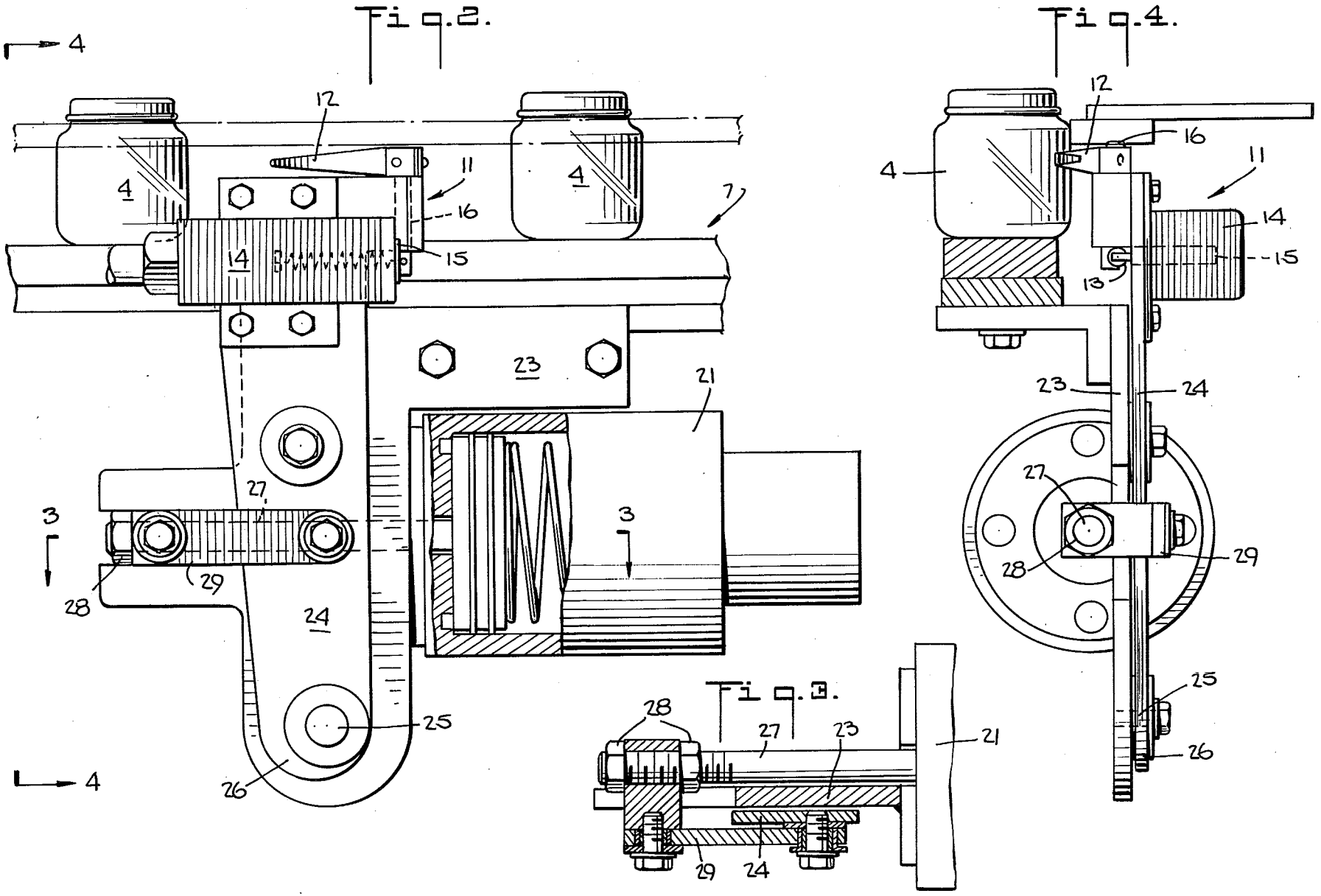
FIG. 2 is a side elevational view, partially in section, of the container sensing means in accordance with the present invention.
FIG. 3 is a horizontal sectional view taken along line 3—3 on FIG. 2.
FIG. 4 is a vertical sectional view taken along line 4—4 on FIG. 2.

In accordance with the present invention, a second Annin or air operated actuator 21 (FIG. 1) is mounted in parallel with the main machine drive actuator 22. The actuator 21 is illustrated in FIGS. 2 through 4. The actuator 21 is mounted on a suitable plate 23 on the container infeed conveyor 7 adjacent to the container detecting device 11. The detecting device 11 is mounted on the upper end of a movable support arm 24 attached by a pivot 25 at its lower end 26 to the support plate 23. A central portion of the detector support arm 24 is adjustably connected to the control rod 27 of the actuator 21 by a link arm 29 (FIG. 3). The compensating action of this combination is as follows. When the speed of the sealing machine 1 is increased by an increase in the machine control air supply at the control actuator 22, the same air pressure increase is applied to the actuator 21 causing its control rod 27 to be retracted or moved to the right as viewed in FIG. 2. This causes a corresponding movement of the container detecting device 11 to the right or away from the sealing machine 1. When moved in this direction, the sensing arm 12 will more quickly detect the termination of the line of containers 4 on the infeed conveyor 7 as the sensing arm 12 has been moved towards the portion of the conveyor 7 from which containers are now absent. This will cause a more rapid transmission of the signal to the cap stop 17 permitting it to terminate the cap feed at the proper cap. A reduction of air pressure at actuators 21 and 22 for a reduction in the machine speed provides an opposite compensating movement of the sensing arm 12.

Since the control rod 27 of the actuator moves in a manner which is synchronized with the sealing machine control air pressure and thus with the sealing machine speed, the above described compensating action will operate over the desired range of sealing machine speeds.

The necessary synchronism between the detecting device 11 action and the cap stop 17 action may be adjusted by adjusting the end nuts 28 which provide for the precise positioning of the support arm 24 with relation to the actuator control rod 27.

Other pairs of actuators where duplicate motions are obtained electrically or electro-mechanically may replace the air operated actuators.

It will be seen that a method and means have been disclosed for improving the performance of container sealing machinery and particularly of high speed or variable speed sealing machines. An automatic method and means are provided for maintaining the container and cap feed in sychronization regardless of machine speed variations. This method and means are operated in combination with the regular sealing machine speed control so that the synchronizing or compensating action is certain and remains directly proportional to the machine speed. Additionally, the method and means are rugged and relatively simple and may be adapted for use with exisiting sealing systems.

As various changes may be made in the form, construction and arangement of the parts herein without departing from the spirit and scope of the invention and without sacrificing any of its advantages, it is to be understood that all matter herein is to be interpreted as illustrative and not in a limiting sense.

Having thus described our invention, we claim:

1. In a sealing machine for sealing containers with closure caps and including a sealing means with a container feed means and a closure cap feed means and having a container sensing device on the container feed means coupled to a cap stop device positioned on the closure feed means for controlling it, an improved synchronizing means for said feed comprising the combination of:

a movable mounting for one of said devices;

said one device being mounted on said movable mounting;

a first control device for adjusting the operating speed of said sealing machine;

a second control device operatively coupled to said movable mounting for adjusting the position of the said one device positioned thereon; and means coupling said first control device to said second control device for moving said second control device in response to movement of said first control device whereby said one device is moved in accordance with adjustments of the machine speed under the control of said first control device.

2. A sealing machine for sealing containers as claimed in claim 1 in which said first and second named control devices comprise air actuated motors having control pistons.

3. A sealing machine for sealing containers as claimed in claim 1 in which said first and second named control devices comprise Annin actuators.

4. A sealing machine as claimed in claim 1 in which said one device comprises the container sensing device.

5. In a sealing machine for sealing containers with closure caps and including a sealing means with a container feed means and a closure cap feed means and having a container sensing device on the container feed means coupled to a cap stop positioned on the closure feed means for controlling it, an improved synchronizing means for said feeds comprising the combination of:

a movable mounting for the container sensing device;

said sensing device being mounted on said movable mounting;

a first control device for adjusting the operating speed of said sealing machine;

a second control device operatively coupled to said movable mounting for adjusting the position of the container sensing device positioned thereon; and means coupling said first control device to said second control device for moving said second control device in response to movement of said first control device whereby said container sensing means is moved in accordance with adjustments of the machine speed under the control of said first control device.

6. A sealing machine for sealing containers as claimed in claim 5 in which said first and second named control devices comprise air actuated motors having control pistons.

7. A sealing machine for sealing containers as claimed in claim 5 in which said first and second named control devices comprise Annin actuators.

8. A sealing machine as claimed in claim 5 in which said container sensing device comprises a movably mounted container detector and a proximity detector positioned adjacent thereto for actuation in response to movement of said container sensing device.

9. A sealing machine as claimed in claim 5 in which said container sensing device comprises a container engaging member urged towards containers on said container feed means by a resilient member.

10. A sealing machine as claimed in claim 5 in which said container sensing device is positioned a plurality of container positions away from said sealing means on said container feed means and said cap stop is positioned a corresponding number of cap positions in said cap feed means away from said sealing means.

* * * * *